US006805552B2

(12) United States Patent
Janouch et al.

(10) Patent No.: US 6,805,552 B2
(45) Date of Patent: Oct. 19, 2004

(54) CATALYTIC GAS COMBUSTION DEVICE FOR AN APPLIANCE FOR PERSONAL USE

(75) Inventors: Peter Janouch, Frankfurt (DE); Peter Lange, Eppstein (DE); Dieter Liebenthal, Maintal (DE); Silvia Rix, Schwalbach (DE); Heinz Kern, Konigstein (DE); Peter Ruppert, Karben (DE); Friedrich Henninger, Kelkheim (DE); Jurgen Seng, Kelkheim (DE)

(73) Assignee: Braun GmbH, Kronberg ( * ) Notice: Subject to any disclaimer, the term of this patent is extended or adjusted under 35 U.S.C. 154(b) by 0 days.

(21) Appl. No.: 10/304,318

(22) Filed: Nov. 26, 2002

(65) Prior Publication Data

US 2003/0138750 A1 Jul. 24, 2003

Related U.S. Application Data

(63) Continuation of application No. PCT/EP01/02769, filed on Mar. 13, 2001.

(30) Foreign Application Priority Data

Jun. 3, 2000 (DE) ..... 100 27 719

(51) Int. Cl.[7] ..... F23Q 11/00

(52) U.S. Cl. ..... 431/268; 431/329; 431/328; 126/409

(58) Field of Search ..... 126/408, 409, 126/413, 414, 92 AC, 401, 403; 431/7, 328, 329, 264, 326, 255, 268; 132/232; 219/225, 240

(56) References Cited

U.S. PATENT DOCUMENTS

| | | | | |
|---|---|---|---|---|
| 3,685,950 A | * | 8/1972 | Nomaguchi et al. | 431/285 |
| 4,502,465 A | * | 3/1985 | Yoshinaga | 126/409 |
| 4,631,024 A | | 12/1986 | Shibata et al. | |
| 4,846,716 A | * | 7/1989 | Courrege | 431/329 |
| 5,394,862 A | | 3/1995 | Firatli et al. | |

FOREIGN PATENT DOCUMENTS

| | | |
|---|---|---|
| DE | 39 36 265 A1 | 5/1990 |
| GB | 2 191 269 A | 12/1987 |

* cited by examiner

*Primary Examiner*—James C. Yeung
(74) *Attorney, Agent, or Firm*—Fish & Richardson P.C.

(57) ABSTRACT

A catalytic gas combustion device for an appliance for personal use with a gas supply device and a catalyst connected to the gas supply device is disclosed. To ignite the gas/air mixture and therefore to initiate catalytic combustion at the catalyst, an ignition device which can be controlled by an ignition system is provided. The gas supply device has a bypass for branching off part of a gas stream which flows onto the ignition device. In this way, the ignition system is actuated even shortly after the gas valve device is opened, and the catalyst is brought to its operating temperature as a result of the explosion of the gas/air mixture.

16 Claims, 2 Drawing Sheets

CATALYTIC GAS COMBUSTION DEVICE FOR AN APPLIANCE FOR PERSONAL USE

CROSS REFERENCE TO RELATED APPLICATIONS

This application is a continuation application of PCT Application No. PCT/EP01/02769, filed Mar. 13, 2001, which claims priority, under 35 U.S.C. 119, from German Application Number 10027719.5, filed Jun. 3, 2000, hereby incorporated by reference in its entirety.

TECHNICAL FIELD

The invention relates to a catalytic gas combustion device for an appliance for personal use, in particular a hair shaping appliance, such as a hair curler or hair dryer.

BACKGROUND

Catalytic gas combustion devices of this type are used in appliances for personal use which generate heat energy by means of gas without electrical current. An appliance of this type is sold, for example, by the applicant itself under the designation HS3 Plus as "Braun Style Shaper". This hair shaping appliance includes a catalytic gas combustion device consisting of a piezoelectric igniter with two ignition electrodes arranged next to one another. These ignition electrodes are arranged in the chamber surrounding the catalyst.

To operate the appliance, the gas supply initially is opened mechanically via a valve device on the gas supply device. Gas flows through the gas supply device, mixing with air, and then passes into the catalyst space. The catalyst includes a tubular screen part, and the gas/air mixture also passes into the chamber, where it is flows around the ignition electrodes. The piezoelectric igniter is then ignited by hand, and sparks jump from one electrode to the other, causing the gas/air mixture in the chamber to ignite and thus initiate catalytic combustion at the catalyst. A certain amount of time elapses before the gas/air mixture reaches the electrodes, and only then is it possible to ignite the gas/air mixture.

The object of the invention is to provide a catalytic gas combustion device for an appliance for domestic use, in particular a gas curler or hair dryer, in which the ignition of the gas/air mixture can be induced shortly after the opening of the gas supply, even simply by the initiation of the ignition operation, so that catalytic combustion commences quickly.

SUMMARY

The invention relates to a catalytic gas combustion device including a bypass. The bypass allows part of the main gas stream to be branched off and supplied to the ignition electrode to cause the combustion of the gas by the actuation of the ignition device after a very short time. As a result, the gas located in the catalyst space and surrounding the catalyst bums abruptly and the catalyst thus reaches its operating temperature, which is necessary for satisfactory catalytic combustion.

The ignition device may be of any desired type, for example, a piezoelectric ignition device, an electric ignition device formed by an incandescent filament or a purely mechanical ignition device. The ignition system operates reliably, since, owing to the short path the gas travels and the rapid flow of the gas around the igniter, the ignition operation can be reproduced and ignition failures avoided. "Gas supply" means those components of the gas combustion device which are connected to the gas valve for controlling the gas flow. Part of the catalyst may be provided in the bypass.

In some preferred embodiments, the gas supply includes a first gas-permeable cover downstream of the bypass. The gas-permeable cover may act in a similar way to a throttle valve, so that a defined quantity of the gas arrives at the ignition device reliably and quickly via the bypass. The higher the gas permeability of the first cover, the more gas is supplied to the chamber of the catalyst and the less gas arrives at the ignition device.

The outlet of the bypass may also include a second gas-permeable cover having a permeability selected in coordination with the first cover, to provide sufficient gas to the ignition device via the bypass. This second cover also has the advantage that the gas explosion advancing from the ignition device does not pass into the chamber of the catalyst via the bypass, but arrives at the catalyst only from outside via the space surrounding the catalyst.

The first and the second covers may consist of a metallic screen, the passages of which pass through a sufficient quantity of the gas both to the catalyst and to the ignition device. The metallic screen of the second cover also may serve as a kind of gas throughflow limiter, so as not to allow too much gas to arrive at the ignition device. The two covers may also serve to improve the mixing of the gas when it flows through the covers.

In some embodiments including the first gas-permeable cover, the gas supply includes a tubular housing for conducting the gas. The tubular housing includes an outlet, and the catalyst includes a bowl-shaped screen body with an inlet connected to the outlet. The first gas-permeable cover is positioned at a transition from the outlet to the inlet. This arrangement results in a particularly simple production of the gas supply device connected to the catalyst and to the cover, since the gas supply device can be produced easily and can be mounted in a simple way.

In some embodiments including the tubular housing, the bypass comprises a slot at the end of the tube including the outlet. The slot is covered by the second cover. This arrangement also allows a simple production of the bypass at the gas supply device, in that a slot is formed laterally at the bore and is delimited at its orifice by the second cover.

In other embodiments including the tubular body, the first cover and the second cover comprise a single covering part. The first cover includes an element having an essentially bowl-shaped cross section, with an adjoining annular flange, and the second cover includes a tab angled on the flange. The production, stock-keeping of parts and assembly of the appliance are simplified considerably owing to the one-part design of the first and second cover as a covering part. This lowers the costs of the appliance.

In some embodiments including the single covering part, the bowl-shaped element is centered in the inlet. The covering part is positioned on the gas supply device in such a way that, at the same time, the tab covers at least part of the slot from the outside. This permits a simple connection of the catalyst to the cover and the gas supply device, in that the cover is centered on the gas supply device and the catalyst is in turn centered on the cover. The catalyst can thereby be connected firmly to the gas supply device, for example via a screw connection, adhesive bonding, plastic deformation or otherwise a generally known fastening device.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
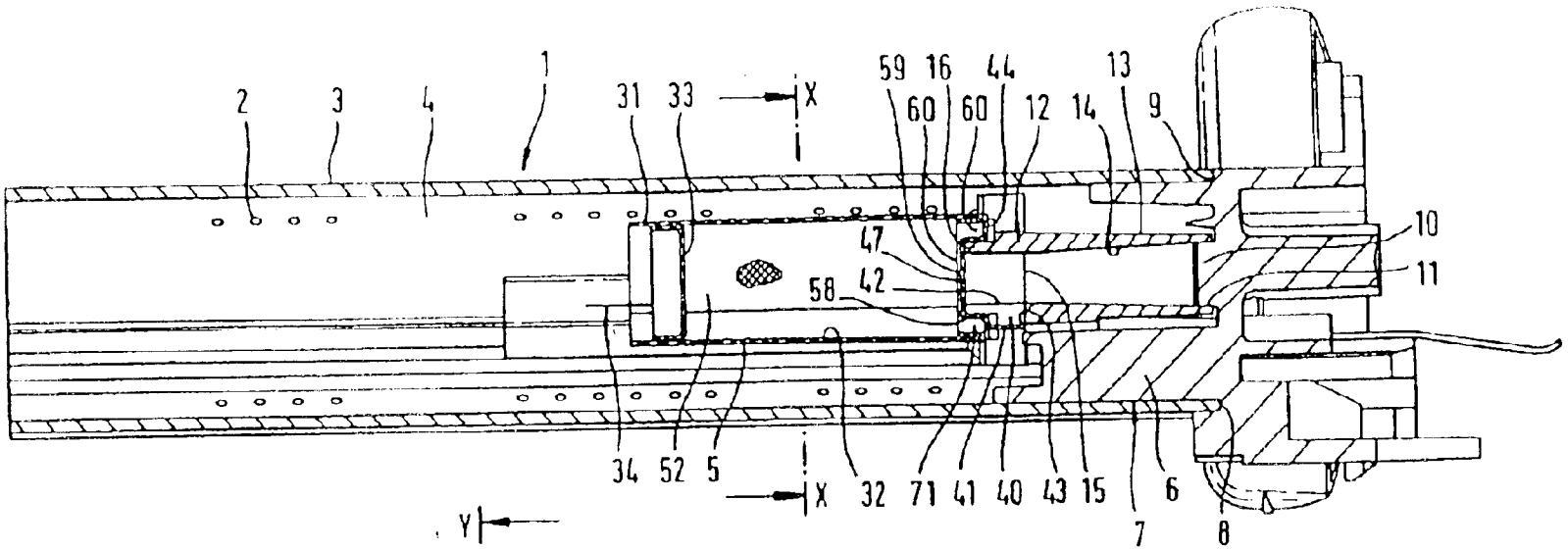
FIG. 1 is a part longitudinal section through a gas-operated curler along the sectional line Y—Y in FIG. 2, in which only the gas supply device connected to the catalyst, the hot-air tube and a base part are illustrated.
Figure 2:
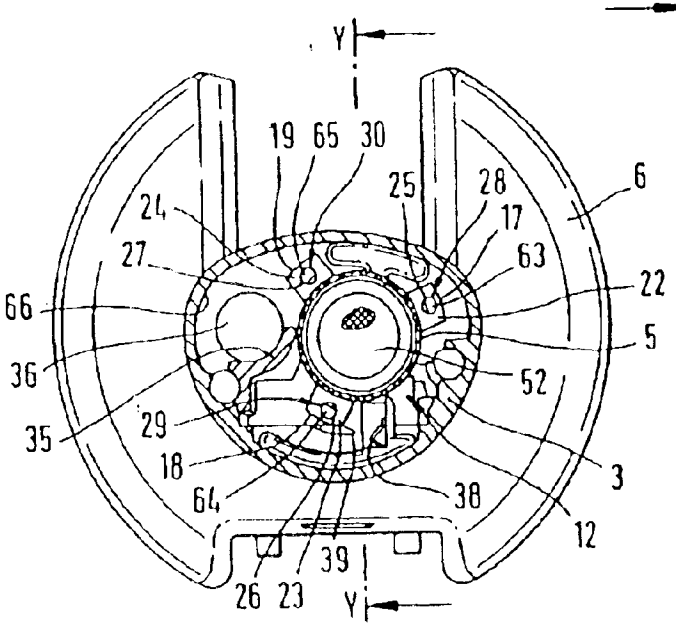
FIG. 2 is a cross section through the gas-operated curler in FIG. 1 along the sectional line.
Figure 3:
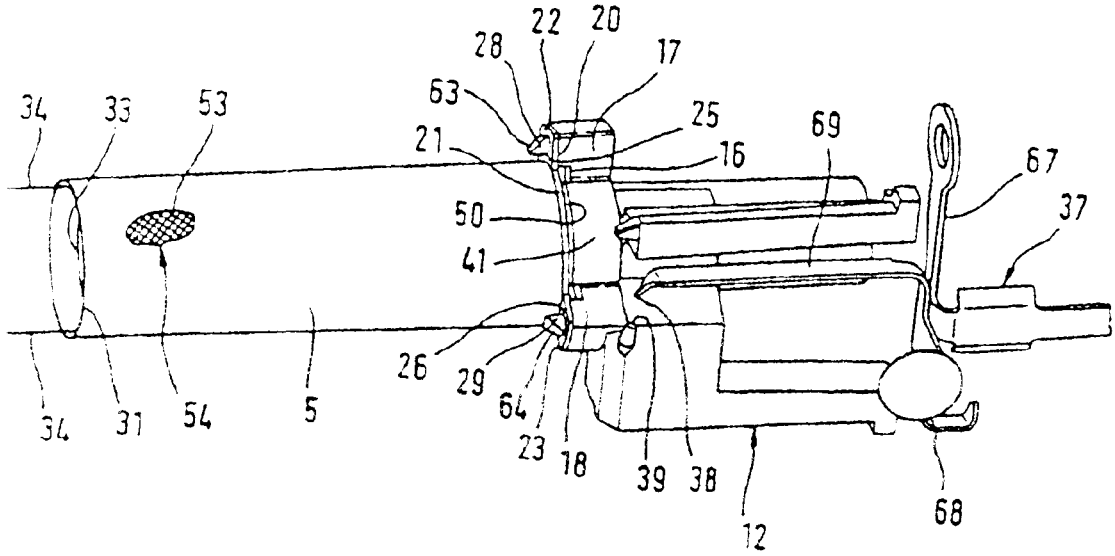
FIG. 3 is a perspective view of the catalyst with its gas supply device and the attached electrodes.

Referring to FIGS. 1 to 3, the curler or hair curler 1, illustrated only partially, consists of a tube 3 which is provided with passages distributed on the circumference and in the chamber 4 of which is arranged a tubular catalyst 5 consisting of a lattice-like material. The tube 3 permeable to heating air is pushed on a centering stub 7 formed on a base 6 and is centered there. In this case, the free end 8 of the tube 3 butts against an end face 9 formed on the base 6 and in this position is connected fixedly to the base 6 via a fastening means not illustrated in the drawing. The base 6 is produced preferably from a plastic part shaped from temperature-resistant plastic. The base 6 serves as a receptacle for an ignition device, a valve device and a gas cartridge with housing, formed in a handle, which are not illustrated in the Figures, as is the case with regard to the appliance described initially.

The base 6 has formed on it a centering pin 10, on the outer face 11 of which a gas supply device 12 is centered and sealingly fastened. The gas supply device 12 is connected firmly to the base 6 via a fastening means not illustrated in the Figures. The gas supply device 12 consists essentially of a central tube 13, the bore 14 of which narrows conically from right to left as far as a step 15, thus ensuring better flow and mixing conditions of the gas/air mixture. From the step 15 on, the bore 15 then runs with a constant diameter as far as the outlet-side free end 16 of the central tube 13.

In particular, referring to FIGS. 2 and 3, three arms 17, 18, 19 distributed on the circumference are formed at the outlet-side free end 16 of the gas supply device 12 and at their front end have a stop face 20 (FIG. 3) lying at the same height.

An annular collar 21 extending perpendicularly away from the tubular catalyst 5 bears against the stop face 20 and in the regions of the arms 17, 18, 19 has radially projecting fastening arms 22, 23, 24. The fastening arms 22, 23, 24 are provided with holes 25, 26, 27 through which pass studs 28, 29, 30 projecting from the arms 17, 18, 19. The catalyst 5 is thereby centered and fixedly held on the gas supply device 12. The fastening of the catalyst 5 on the gas supply device 12 takes place in that the studs 28, 29, 30 after they have passed through the holes 25, 26, 27 according to FIGS. 1 to 3, are deformed mechanically in such a way that they make a positive connection in a similar way to a rivet. The Figures illustrate the state just before deformation. In order to allow deformation more easily, the ends of the studs 28, 29, 30 are provided with oblique faces 63, 64, 65.

Referring to FIG. 1, a cap 33 which consists of the same screen material as the catalyst 5 is inserted into the bore 32 of the free end 31 of the catalyst 5. At the free end 31 of the catalyst 5, fine wire hairs 34 project, which, because of their low mass, serve as a starting aid during the ignition operation and thus bring the catalyst 5 itself to its incandescent temperature simply and quickly. Referring to FIG. 2, the tube 3 is designed with an essentially oval cross section and has a curved wall 35 which extends from the inner wall 66 inward into the vicinity of the catalyst 5 and which partially covers a thermostat 36 partially protecting the catalyst 5 against heat radiation. Both the thermostat 36 and the wall 35 run in the longitudinal direction and parallel to the catalyst 5.

Referring FIGS. 1 and 3, a sheet-metal strip 37 provided with anglings 67, 68 runs from the right, one portion 69 of which runs to level with the arms 17, 18, 19 and, angled there, terminates in an arrow tip 38. A laterally arranged lug 39 thin in diameter and formed on the gas supply device 12 projects with a slight clearance. The lug 39 forms, with the arrow tip 38, the ignition electrodes of the ignition device, via which electrodes one or more sparks flash over to the lug 39, for example when a sufficiently high voltage is applied to the sheet-metal strip 37. The sheet-metal strip 37 is, of course, insulated relative to the gas supply device 12 and to the housing parts of the curler 1 via insulating means which are not illustrated.

Figure 4:
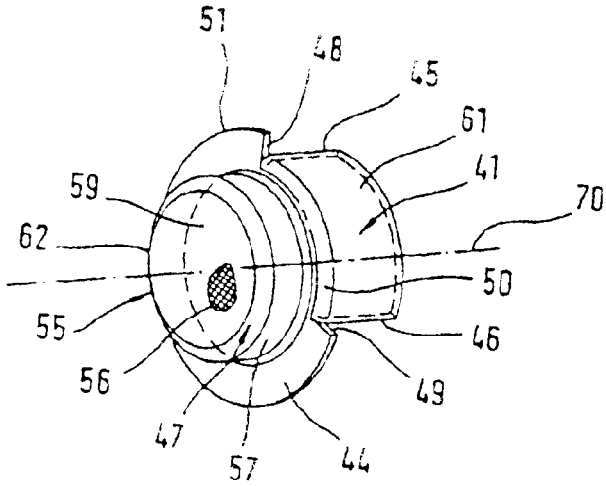
FIG. 4 is a perspective view of the covering part consisting of the first and second cover.

A bypass 40 is formed in the gas supply device 12 at the cylindrical portion of the bore 14 and is delimited outwardly by a second cover 41 consisting of a wire lattice. As clearly shown particularly in FIG. 4, the second cover 41 describes part of a cutout of a hollow cylinder; the face of the outlet orifice of the bypass 40 runs parallel to said second cover, that is to say is curved in the same manner. The bypass 40 has an inlet orifice 42 and the outlet orifice 43, the outlet orifice 43 adjoining the second cover 41. According to FIG. 4, a flange 44 running transversely to the second cover 41 and forming the cutout of an annular disk runs laterally away from the edge 45, 46, the center axis 70 of the flange 44 being at the same time the center axis 70 of the second cover 41. A bowl-shaped first cover 47 adjoins the flange 44.

The first cover 47, with its flange 44, forms essentially a structure 62 having a hat with a rim, although the flange 44 is indented at two points 48, 49, and this part, which forms the second cover 41, is bent downwardly at right angles to the flange 44 via the bending line 50 and thus forms a tab 61. However, in the not yet angled state, the second cover 41 of essentially rectangular cross section, that is to say the tab 61, already projects radially outward at the rim 51 of the flange 44, in order subsequently, in the bent-round state, to cover the entire cross section of the outlet orifice 43. In alternative embodiments only part of the second cover 41 may cover the face of the outlet orifice 43, particularly if sufficient gas/air mixture already arrives at the electrodes 38, 39 as a result and, at the same time, a sufficient amount of gas/air mixture likewise flows into the space 52 before the ignition operation and from there, via the gas-permeable orifices 53 of the catalyst 5, into the chamber 4.

Referring to FIG. 3, a cutout 54 on the surface of the catalyst 5 shows that the wall of the catalyst 5 includes a large number of small orifices 53, for example, a wire netting, through which the gas/air mixture can enter the chamber 4 before the ignition operation. The same applies to the first and second cover 47, 41 which are combined into a single covering part 55 and in which the material is likewise produced in lattice-form with small passages 56. The covering part 55 is a punched, bent and pressed part, preferably consisting of fine wire fabric.

The first cover 47 has a cylindrical portion 57 which is centered on the outside diameter 58 of the free end 16 of the gas supply device 12. In this case, the disk-shaped portion 59 adjoining the cylindrical portion 57 completely covers the inlet orifice 60 of the catalyst 5 in this region and the bore 14, as is shown in FIG. 1. Since the inlet orifice 60 of the catalyst 5 is larger than the outside diameter of the free end 16 of the central tube 13, an annular inlet or outlet orifice 71 is obtained, via which gas/air mixture can likewise flow into or out of the space 52 of the catalyst 5.

The catalytic gas combustion device for a curler or hair curler 1 operates as follows:

First, a gas valve, not illustrated in the drawing, is opened via a valve actuation element (not illustrated) arranged rotatably or displaceably on the base 6. Gas flows via the gas cartridge, not illustrated in the drawing, through the valve device, is mixed with air and then passes, via a duct (not illustrated) formed in the base 6 in the drawing, into the bore 14 of the gas supply device 12 and is accelerated there (the conically narrowing bore portion 14 serves as a Venturi tube). The gas/air mixture then flows, on the one hand, through the disk-shaped portion 59 into the space 52 of the catalyst 5 and, on the other hand, also via the inlet orifice 42 into the bypass 40 to the outlet orifice 43 and from there into the chamber 4 surrounding the outer face of the catalyst 5. Since the tips of the ignition electrodes 39, 40 are adjacent to the bypass 40, the gas/air mixture flows around these immediately after leaving the outlet-side end 16 of the bore 14. At the same time, the gas/air mixture located in the space 52 passes through the orifices 53 of the catalyst 5 into the chamber 4, is distributed there and consequently also flows in the direction of the ignition electrodes 38, 39.

Even only a few seconds after the gas valve device is opened, then, an actuating knob fastened laterally to the base 6 in the drawing can be actuated, in order to actuate an ignition system not illustrated in the drawing. As a result, high voltage is applied to the sheet-metal strip 37 and therefore also to the arrow tip 38. Due to the voltage difference between the arrow tip 38 and the housing-side grounded lug 39, sparks (not illustrated) jump over from the arrow tip 38 to the lug 39, by means of which sparks there is an immediate explosion of the gas/air mixture located in the surroundings of the ignition electrodes 38, 39.

The explosion wave then travels upward from the ignition electrodes 38, 39 as far as the wire hairs 34 which, on account of their low mass, are immediately brought to incandescence. The incandescence process is propagated from there via the edge of the free end 31 of the catalyst 5 until the entire catalyst 5 is incandescent. Catalytic combustion has commenced, and the combustion gases discharged as a result of combustion flow along in the chamber 4 and ultimately emerge outward as still hot gas from the passages 2 of the tube 3. The tube 3 heats up, and after a short time the curler 1 is ready for operation, that is to say hairs can be laid around the outer face of the tube 3 and are then heated or even also additionally dampened by means of an evaporator device (not illustrated) integrated in the curler, so that long-lasting curls in the strands of hair can be formed quickly.

The gas/air permeability of the first and second cover 47, 41 is dimensioned such that a sufficiently large quantity of gas/air mixture arrives at the ignition electrodes 38, 39 in a particularly short time. A sufficient gas/air quantity also simultaneously passes into the space 52 of the catalyst 5. This ratio of the gas/air mixture distribution must be coordinated exactly, in order, on the one hand, to accelerate the explosion process in terms of time and also generally to improve it and, on the other hand, in spite of the bypass 40, also to bring about sufficient catalytic combustion in the catalyst 5. The gas/air mixture flowing via the bypass during operation then additionally supplies the chamber 4 with fuel, in order also to obtain particularly uniform catalytic combustion on the outer face of the catalyst 5.

After an operator has treated the hair by means of the curler 1, the gas valve can be closed again and catalytic combustion is terminated, that is to say the curler 1, but, in particular, the tube 3, cools down again. The curler 1 can be laid to one side. It may also be mentioned at this juncture, that a closing cap (not illustrated) is present at the left free end of the tube 3. This closing cap may, however, also be replaced by an evaporator device (not illustrated).

Other embodiments are within the claims.

What is claimed is:

1. A hair care appliance comprising a gas supply device that provides a stream of an ignitable air/gas mixture to a catalyst, the gas supply device having a bypass upstream of the catalyst for branching off part of the ignitable air/gas mixture from the stream to an ignition device, also upstream of the catalyst, for igniting the ignitable air/gas mixture and initiating catalytic combustion of the catalyst.

2. The hair care appliance as claimed in claim 1, wherein the gas supply includes a first gas-permeable cover downstream of the bypass.

3. The hair care appliance as claimed in claim 2, wherein the bypass includes a second gas-permeable cover.

4. The hair care appliance as claimed in claim 2, wherein first gas-permeable cover comprises a metallic screen.

5. The hair care appliance as claimed in claim 3, wherein the second gas-permeable cover comprises a metallic screen.

6. The hair care appliance as claimed in claim 3, wherein the gas supply comprises a tubular housing for conducting the ignitable air/gas mixture, the tubular housing having an outlet, wherein the catalyst comprises a bowl-shaped screen body with an inlet connected to the outlet, and wherein the first gas-permeable cover is positioned at a transition from the outlet to the inlet.

7. The hair care appliance as claimed in claim 6, wherein the bypass comprises a slot at the end of the tube comprising the outlet and the slot is covered by the second cover.

8. The hair care appliance as claimed in claim 6, wherein the first cover and the second cover comprises a single covering part, wherein the first cover comprises an element having an on essentially bowl-shaped cross section, with an adjoining annular flange, and the second cover comprises a tab angled on the flange.

9. The hair care appliance as claimed in claim 8, wherein the bowl-shaped element is centered in the inlet, and wherein the covering part is positioned on the gas supply device in such a way that, at the same time, the tab covers at least part of the slot from outside.

10. The hair care appliance of claim 1, further comprising a wire hair, at the downstream end of the catalyst, that initiates catalytic combustion of the catalyst in response to the igniting of the ignitable air/gas mixture by the ignition device.

11. The hair care appliance of claim 1, the gas supply device further comprising a Venturi tube from which the stream of the ignitable air/gas mixture is provided.

12. A catalytic gas combustion device hair care appliance for an appliance for personal use comprising a gas supply device that provides a stream of gas to a catalyst and an ignition device for igniting the gas and initiating catalytic combustion at the catalyst, wherein the gas supply has a bypass for branching off part of the stream of gas onto the ignition device, wherein the gas supply includes a first gas-permeable cover downstream of the bypass and the bypass includes a second gas-permeable cover, and wherein the gas supply comprises a tubular housing for conducting the gas, the tubular housing having an outlet, wherein the catalyst comprises a bowl-shaped screen body with an inlet connected to the outlet, and wherein the first gas-permeable cover is positioned at a transition from the outlet to the inlet, and wherein the bypass comprises a slot at the end of the tube comprising the outlet and the slot is covered by the second cover.

13. A catalytic gas combustion device hair care appliance for an appliance for personal use comprising a gas supply device that provides a stream of gas to a catalyst and an ignition device for igniting the gas and initiating catalytic combustion at the catalyst, wherein the gas supply has a bypass for branching off part of the stream of gas onto the ignition device, wherein the gas supply includes a first gas-permeable cover downstream of the bypass and the bypass includes a second gas-permeable cover, wherein the gas supply comprises a tubular housing for conducting the gas, the tubular housing having an outlet, wherein the catalyst comprises a bowl-shaped screen body with an inlet connected to the outlet, and wherein the first gas-permeable cover is positioned at a transition from the outlet to the inlet, and wherein the first cover and the second cover comprises a single covering part, wherein the first cover comprises an element having an on essentially bowl-shaped cross section, with an adjoining annular flange, and the second cover comprises a tab angled on the flange.

14. The catalytic gas combustion device hair care appliance as claimed in claim 13, wherein the bowl-shaped element is centered in the inlet, and wherein the covering part is positioned on the gas supply device in such a way that, at the same time, the tab covers at least part of the slot from outside.

15. A method of treating hair, comprising treating hair with a hair care appliance comprising a gas supply device that provides a stream of an ignitable air/gas mixture to a catalyst, the gas supply device having a bypass upstream of the catalyst for branching off part of the ignitable air/gas mixture from the stream to an ignition device, also upstream of the catalyst, for igniting the ignitable air/gas mixture and initiating catalytic combustion of the catalyst.

16. The method of claim 15, wherein the hair care appliance is a hair curler.

* * * * *

UNITED STATES PATENT AND TRADEMARK OFFICE

CERTIFICATE OF CORRECTION

PATENT NO. : 6,805,552 B2
DATED : October 19, 2004
INVENTOR(S) : Peter Janouch et al.

It is certified that error appears in the above-identified patent and that said Letters Patent is hereby corrected as shown below:

Column 8,
Line 6, delete "on"

Signed and Sealed this

Twenty-second Day of February, 2005

JON W. DUDAS
*Director of the United States Patent and Trademark Office*